United States Patent [19]

Blake

[11] 4,088,248

[45] May 9, 1978

[54] SPRAYER-DISPENSER PUMPS

[76] Inventor: William S. Blake, 10231 Bellehurst, Westminster, Calif. 92683

[21] Appl. No.: 708,954

[22] Filed: Jul. 22, 1976

[51] Int. Cl.[2] ..... B65D 37/00

[52] U.S. Cl. ..... 222/207; 222/213; 239/350; 239/362

[58] Field of Search ..... 222/207, 212–215, 222/321, 380, 383, 402.14, 402.25, 442; 251/320, 353, 354; 239/350, 362

[56] References Cited

U.S. PATENT DOCUMENTS

| | | | |
|---|---|---|---|
| 2,543,850 | 3/1951 | Henricson | 222/213 X |
| 2,662,669 | 12/1953 | Schmidt | 251/354 X |
| 2,671,578 | 3/1954 | McBean | 222/214 X |
| 2,772,817 | 12/1956 | Jauch | 222/207 |
| 2,804,240 | 8/1957 | Anderson | 222/207 |
| 2,884,164 | 4/1959 | Kleid | 222/207 |
| 2,942,762 | 6/1960 | Fahr | 222/207 |
| 3,160,329 | 12/1964 | Radie et al. | 222/212 X |
| 3,220,611 | 11/1965 | Zander et al. | 222/207 X |
| 3,282,474 | 11/1966 | Gorman | 251/353 X |

*Primary Examiner*—Allen N. Knowles
*Assistant Examiner*—Fred A. Silverberg
*Attorney, Agent, or Firm*—Knobbe, Martens, Olson, Hubbard & Bear

[57] ABSTRACT

A two-piece flexible bulb is clamped on the open upper end of a container by a ferrule which seals against the upper section of the bulb. A dispenser head mounted on a pressure pad on the upper bulb section includes a bayonet valve stem which engages a flap-type outlet valve formed on the upper bulb section. Depressing the head sufficiently distorts the bulb which creates pressure in the chamber, and also compresses the pressure pad which permits the valve stem to open the outlet valve. Depressing the upper bulb section breaks the seal between the bulb and the ferrule, thus, allowing air into the container to replace the product which is sucked into the chamber through a flap-type check valve in the lower bulb section, after the dispenser head is released. In alternate arrangements, the flap valves are replaced by flexible valve openings which cooperate with valve stems to open the valves when the bulbs are distorted by depressing the dispenser heads.

18 Claims, 7 Drawing Figures

SPRAYER-DISPENSER PUMPS

The present invention relates to fluid dispensing pumps and more particularly to improved pumps which provide fluid at a predetermined substantially constant pressure.

A wide variety of manually operated pumps have been developed for dispensing material from containers for a large number of different products. Although such pumps have been becoming more sophisticated and numerous improvements have been made in their design, a need still exists for further improvements particularly in view of the high-volume production of such items.

Pumps are now available which will provide dispensing with a fairly uniform stream or spray without dribbling and which have venting systems for enabling air to enter the container without leakage of product. Because of these various requirements, a need still exists for improvements in operation and in manufacturing costs and reliability of such pumps.

In accordance with the present invention, a dispenser pump is provided having a flexible bulb formed of two sections with an inlet valve formed on the lower section that opens only to allow product to be sucked into the bulb chamber, and an outlet valve in the upper section which opens only to allow product under pressure to be dispensed from the chamber. A dispenser head which fits over a cylindrical portion on the upper bulb section compresses the bulb and carries a valve stem which penetrates or opens the valve in the upper valve section upon application of sufficient pressure on the dispenser head to create pressure within said chamber and to compress the bulb upper portion against said chamber pressure to cause the valve stem to move slightly to open the valve.

In an alternative arrangement, the flexible flaps forming the valve sealing surfaces are replaced by a sealing bead formed on the bulb, and the valve stem on the dispenser head extends into the orifice formed by the sealing bead to form a normally closed outlet valve. Slight penetration of the valve stem further into the orifice formed by the bead occurs when the dispenser head is depressed sufficiently and connects an internal passage of the valve stem with the bulb chamber so that product can be passed into the dispensing head.

The lower inlet valve for the bulb formed of two flexible flaps may be replaced by an annular flap defining a valve seat, and a fixed valve stem supported beneath the inlet valve seat prevents flow out of the chamber through the inlet valve. Upon application of suction to the chamber, the annular flap can move upward slightly away from the valve stem to permit product to flow into the chamber.

In another variation of the outlet valve in the upper part of the bulb, a valve stem carried by the dispenser head includes a flange on its lower end which mates with an inner annular valve seat on the upper end of the bulb. This valve seat is distorted away from the flange by the creation of sufficient pressure within the chamber caused by depressing the dispenser head against the bulb upper end. This permits the chamber pressure to be applied to a further valve orifice formed by an inwardly extending annular flap in a tubular portion of the bulb above the lower end of the valve stem. The valve stem includes a further shoulder surface which normally closes the second valve orifice. However, upon development of sufficient pressure within the chamber, the flap will be moved upwardly slightly to permit product to flow from the chamber.

Each of these dispenser pumps provides a fairly uniform stream of product under a substantially constant pressure due to the fact that the outlet valves will not open until a significant pressure is developed within the chamber, and the outlet valves will close quickly as the pressure drops. This also has the advantage of preventing leakage or dribbling from the dispenser head.

Advantages of the arrangements are that there are no springs, the product does not contact any metal components in the pump, there are a relatively few number of parts, and there are no cumulative precise tolerances.

Each of the various flexible bulbs are preferably formed with outwardly extending flanges that may be supported on the open upper end of a dispenser container. These flanges are clamped to the upper end of the container by a ferrule which has an annular upper edge which engages an adjacent surface of the flexible bulb. The flanges are also provided with inlet port holes for air to enter the container to replace product as it is dispensed. The ferrule seals against the bulb to prevent leakage through the flange holes. However, when the bulb is distorted, the bulb surface adjacent the ferrule is moved to break the seal so that air may enter the container.

In an alternative arrangement, the bulb is provided with an upwardly extending annular wall adjacent the flange on the upper section of the bulb. The ferrule seals against the exterior surface of this upwardly extending wall. The wall is distorted inwardly to break the seal when the bulb is depressed. To facilitate this movement, the annular wall is connected to the body of the bulb by a series of radially extending ribs or bridges.

For a more thorough understanding of the invention, refer now to the following detailed description and drawings in which.

Figure 1:
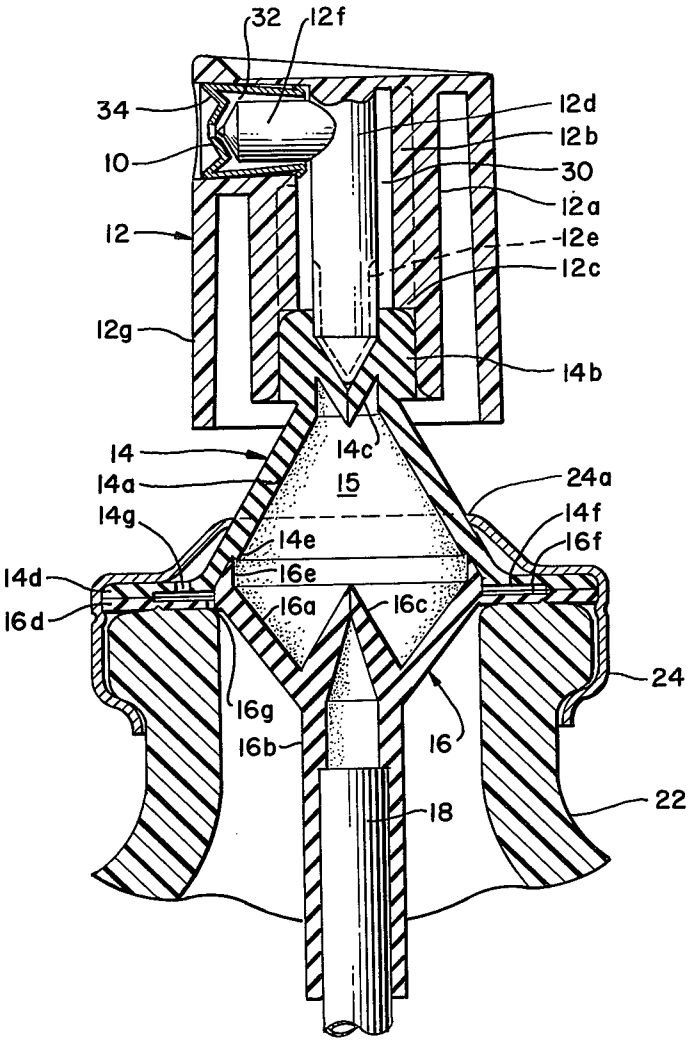
FIG. 1 is a cross-sectional view of a preferred form of the invention showing the pump in its undepressed position.

Referring now to FIG. 1, the dispenser pump illustrated may be seen to include only six parts, namely, an orifice cup 10 positioned in a dispenser head 12 mounted on the upper end of an upper flexible bulb section 14, which mates with a lower flexible bulb section 16 to form a pump chamber 15, a dip tube 18 extending into a container 22, and a ferrule 24 which clamps the pump on the open upper end of the dispenser container.

The lower bulb section 16 has a generally conical side wall **16*a* which joins with a lower tubular portion 16*b* which fits over the upper end of the dip tube 18. Extending inwardly and upwardly from the tubular portion 16*b* are a pair of flaps 16*c* forming an inlet check valve. The flaps are molded to be normally in contact with each other as shown in FIG. 1 so that fluid within the chamber 15 cannot flow into the container 22. Also, the pressure within the chamber 15 acts against the upper surfaces of the flaps 16c to hold them in the closed position. The flaps 16c are sufficiently resilient and flexible such that they will easily open when the pressure within the chamber 15 is less than the pressure in the tubular portion 16b, so that product can be sucked from the container through the dip tube 18**.

The lower bulb section 16 is further provided with a thin outwardly extending flange 16d which engages the container surface defining the opening into the container. The upper bulb section 14 has a similar outwardly extending flange 14d which mates with and rests on the flange 16d of the lower bulb section. The upper bulb section 14 has a conical side wall 14a which mates with the upper edge of the lower bulb section 16. More specifically, the lower bulb section has an upwardly extending wall 16e having a cylindrical configuration on its interior and having a tapered or frusto-conical shape on its exterior which fits within an annular shoulder 14e formed on the lower edge of the side wall 14a of the upper bulb section.

A ferrule 24 fits over the bulb sections and clamps the flanges 14d and 16d onto the upper end of the container by engaging a lip on the container. A threaded closure could of course be employed if the container has threads. The upper circular edge 24a sealingly engages the outer periphery on the lower end of the side wall 14a of the upper bulb section, to prevent leakage into or out of the container.

The flange 16d is formed with an annular recess 16f which mates with a similar annular recess 14f. One or more holes 16g extend from the recess 16f to the lower surface of the flange 16d; and similarly, one or more holes 14g are formed in the flange 14d and connect the annular recess 14f with the upper surface of the flange. Thus, if the bulb wall section 14a is moved away from the sealing edge 24a of the ferrule, the interior of the container is open to the surrounding air so that air may enter the container.

The upper end of the upper bulb section 14 is formed with a thickened tubular portion 14b that surrounds an outlet check valve 14c formed by inwardly and downwardly extending flaps that are integral with the interior wall of the tubular portion 14b. These flaps, similar to the flaps 16c, are molded to be self-biased into closed position. Also, the downwardly facing surfaces are angled so that pressure within the chamber 15 will urge the flaps to remain in the closed position.

The dispenser head 12 is preferably made of rigid plastic material and includes an inner tubular section 12a having a series of inwardly extending ribs 12b which define a downwardly facing shoulder 12c. The lower end of the tubular wall 12a is sized to fit snuggly onto the upper tubular portions 14b of the upper bulb section. The internal shoulders 12c engage the upper surface of the bulb tubular portion 14b. Thus, the dispenser head is adequately supported on the bulb and cannot be depressed without distorting the bulb.

In the central section of the dispenser head there is positioned a downwardly extending bayonet valve stem 12d which has its lower tip conically shaped to conform to the upper surface of the flaps 14c and the cylindrical portion of the valve stem fits within the interior of the bulb tubular portion 14b. The dotted line on the lower end of the valve stem 12d defines a groove 12e which opens to an annular passage 30 between the valve stem 12d and the surrounding tubular wall 12a. The upper end of the passage 30 is open to a radially extending cylindrically shaped orifice 32 surrounding a projection 12f. An orifice cup 34 snaps into the orifice 32 to provide a desired spray pattern. An outer cylindrical skirt or wall 12g forms the exterior of the dispenser head.

Figure 2:
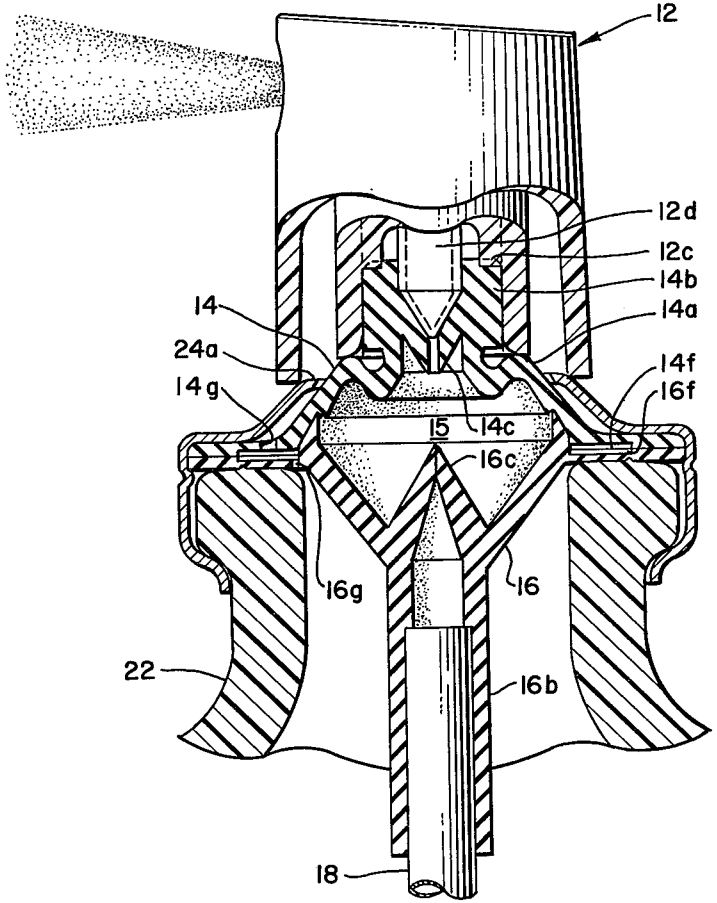
FIG. 2 is a cross-sectional view of the pump of FIG. 1 with the bulb in depressed condition.

Turning now to the operation of the dispenser pump, depressing the dispenser head 12 transmits force to the flexible bulb, since the shoulder 12c on the dispenser head is engaging the upper end of the tubular portion 14b of the upper bulb section 14. Thus, initially, the valve stem 12d cannot penetrate the valve flaps 14c and open the valve. However, downward pressure on the bulb distorts the upper bulb section 14 as shown in FIG. 2. This action creates pressure within the pump chamber 15. When a predetermined pressure is developed within the pump chamber, further force applied on the bulb through the dispenser head will cause the resilient thickened tubular portion 14b to be compressed slightly so that the valve stem can move downwardly with respect to the bulb tubular portion 14b and penetrate or separate the valve flaps 14c, thus opening the valve. The contents of the pump chamber will then be dispensed out the orifice cup 34 under pressure. As soon as this pressure drops, the resiliency of the pressure pad or tubular portion 14b restores the valve stem 12d to its withdrawn position with respect to the valve flaps 14c, as shown in FIG. 1; and the self-biasing of the flaps 14c, coupled with the reaction of the remaining pressure within the chamber 15 against the underside of the flaps 14c, causes the flaps to close quickly. Thus, the contents being dispensed will be under a substantially constant or uniform pressure.

As the bulb reaches its lowermost position, the bulb wall 14a separates slightly from the ferrule edge 24a, permitting air to enter the container through the flange vent passage.

Releasing the dispenser head completely permits the bulb section 14 to be restored to its normal shape as shown in FIG. 1. The bulb section 14 will return to its original state due to its resiliency, without the benefit of a spring or other outside force. Since the outlet valve 14c closes before the bulb has been restored to its undepressed condition, suction is created in the chamber 15 when the bulb shape is restored. This causes the inlet valve flaps 16c to open, permitting product in the container 22 to be sucked into the chamber through the dip tube 18. This product is ready to be dispensed when the dispenser head is once more depressed sufficiently to open the outlet valve flaps 14c.

Figure 3:
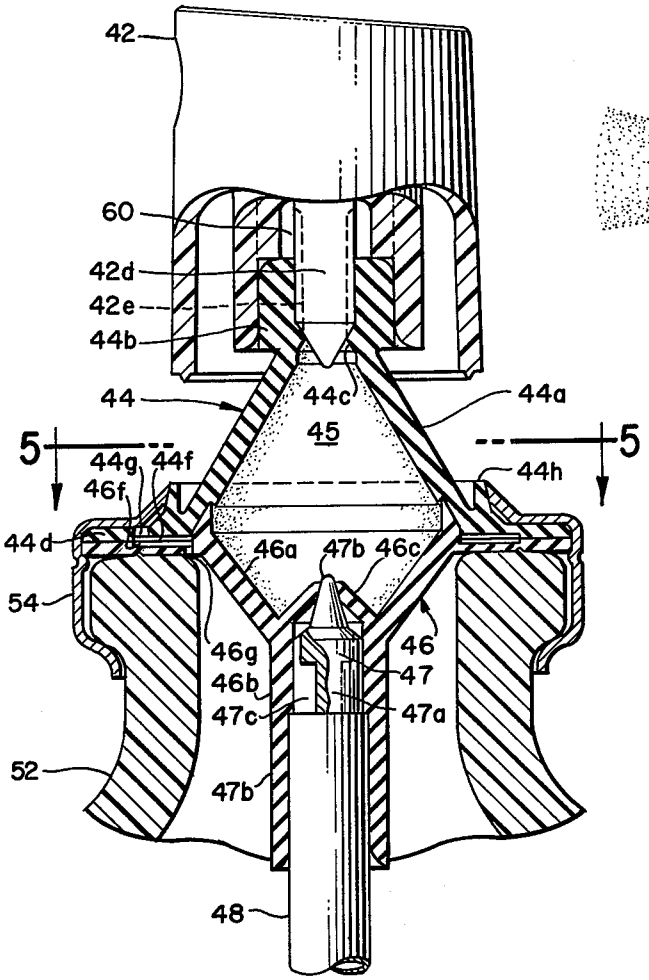
FIG. 3 is a cross-sectional view of an alternative embodiment of the invention with the bulb in its undepressed condition.

Referring now to FIG. 3, the embodiment of the pump shown therein is very similar in structure and operation to the arrangement in FIG. 1. Instead of having integrally formed valve flaps, an upper bulb section 44 is formed with an inwardly extending sealing bead 44c within an upper, thickened tubular portion 44b. A bayonet valve stem 42d extends into the cylindrical interior of the bulb tubular portion 44b so that the lower, conically tapered surface of the valve stem 42d engages the sealing bead 44c. The valve stem 42d is formed with two or more axially extending grooves 42e on its lower end portion which is positioned within the bulb tubular portion 44b. The grooves 42e extend above the bulb so they are in communication with the surrounding annular passage 60 in the dispenser head, but the lower ends of the grooves 42e terminate just above the sealing bead 44c, with the dispenser head in a nondepressed position, as shown in FIG. 3.

However, when the dispenser head is depressed, the operation is similar to that for the pump shown in FIG. 1. First, the pressure on the dispenser head distorts the bulb section 44 into the configuration shown in FIG. 4. Once this distortion creates a predetermined pressure within the pump chamber 45, further force applied to the dispenser head will compress the tubular portion 44b, which is in effect an elastic, pressure yielding pad. The compression of this pad will permit the bayonet stem to extend slightly further into the bulb section 44 so that the lower ends of the grooves 42e are open to the chamber 45, so that the contents of the chamber are dispensed outwardly under pressure. The advantage of this outlet valve is that it is slightly easier to mold than are the valve flaps 14c in the FIG. 1 embodiment.

A second difference between the embodiments of FIGS. 1 and 3 is that the inlet valve on the lower end of the lower bulb section 46 is in the form of an annular flexible flap 46c which defines a small valve orifice. A valve stem 47 is positioned within the upper end of a tubular portion 46b on the bulb section 46. The valve stem includes a lower cylindrical portion 47a which frictionally fits within the tube 46b and an upper conically shaped portion 47b which mates with and extends into the small valve opening formed by the annular flap 46c. Within the outer circumferance of the cylindrical portion 47a of the valve stem 47, there are provided a series of axially extending grooves 47c. When the depressed bulb section 44 is released and it reverts to its normal shape, the suction created within the pump chamber 45 will lift the annular flap 46 slighly so that product can be sucked from the container 52 up through the dip tube 48, through the grooves 47c, passed the valve stem tip 47b and into the pump chamber 45.

Like the outlet valve 44c and 42d, an advantage of this form of inlet valve 46c and 47b is that the flap 46c is easier to mold than the flaps 16c. On the other hand, an additional part is required.

Figure 5:
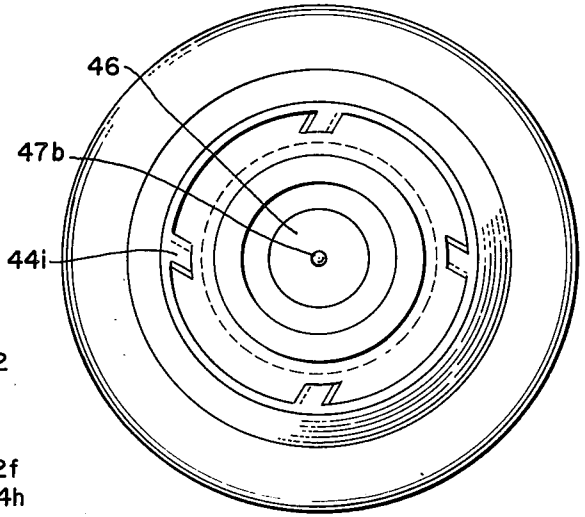
FIG. 5 is a cross-sectional view on lines 5 — 5 in FIG. 3 showing the ferrule peripheral vent seal and showing the inlet valve.

A third major difference between the dispenser pump embodiments of FIGS. 1 and 3 concerns the construction of the air venting system for the container. The upper valve section 44 is provided with an upwardly extending cylindrical wall 44h at the juncture between the conical side wall 44a and the outwardly extending flange 44d. The inner cylindrical surface of the wall 44h is spaced from the lower portion of the conical wall 44a, being joined to the upper bulb section only at its base except for a series of inwardly extending ribs 44i which are shown in FIG. 5. As can be seen these ribs do not extend completely radially but are slightly at an angle with respect to a radius; and the sides of the ribs are not parallel to the central axis of the bulb section 44. Instead, the sides of the ribs 44i are sloped so that one side is undercut, as viewed in FIG. 5; and the other side is parallel to this.

Figure 4:
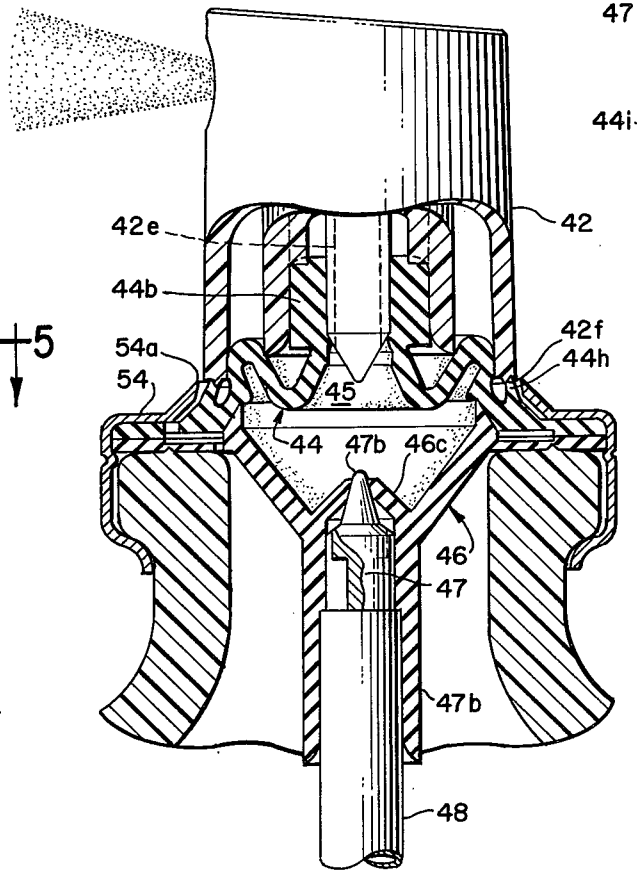
FIG. 4 is a cross-sectional view of the pump of FIG. 3 with the bulb is depressed condition.

When the dispenser head 42 is fully depressed, as shown in FIG. 4, a depending annular bead 44f engages the upper edges of the bridges 44i (FIG. 5) pulling the wall 44h slightly inwardly at the rib locations. This action breaks a seal with the surrounding annular edge 54a of a ferrule 54 which clamps the bulb sections 44 and 46 to the upper open end of the container 52. This permits air to enter the container through the passages 44f and 44g and 46f and 46g in the flanges of the bulb sections.

The advantage of the peripheral seal created by the wall 44h and the ferrule edge 54a is that the making and breaking of the seal is perhaps slightly more positive than that in the arrangement of FIG. 1, in view of the additional flexibility of the wall 44h.

Figure 6:
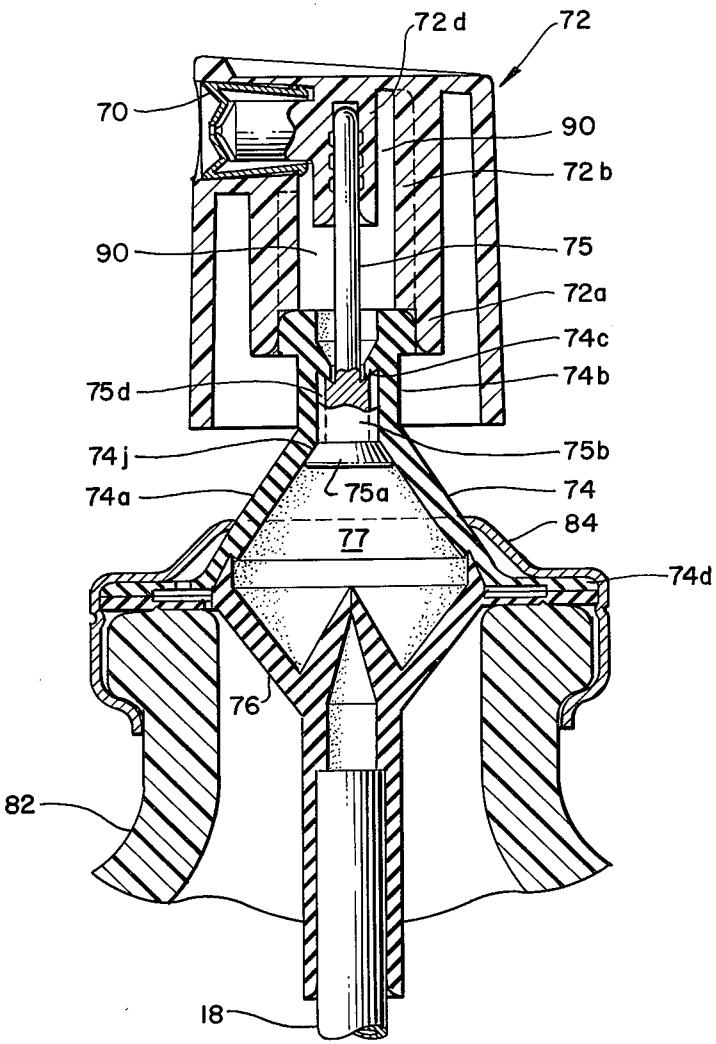
FIG. 6 is a cross-sectional view of another embodiment of the invention having a different outlet valve structure.

Referring now to the dispenser pump arrangement in FIG. 6, there is shown a flexible, resilient bulb formed by an upper section 74 having a conical side wall 74a and an outwardly extending flange 74d which are essentially like the corresponding portions of the bulb section 14 shown in FIG. 1. Also, a lower bulb section 76, a dip tube 18, a ferrule 84 and a container top 82 are essentially like the corresponding components shown in FIG. 1. The upper portion of the upper bulb section 74 and the outlet valve for the pump chamber is different.

The upper portion of the bulb section 74 includes a neck or tubular section 74b having a wall thickness similar to or slightly smaller than the conical wall portion 74a, except that the upper section is enlarged to fit within a cylindrical wall 72a on a dispenser head 72. This dimensioning is convenient so that the dispenser head construction is similar to the dispenser head used in the arrangement of FIG. 1. Positioned within the tubular portion 74b is an annular inwardly and downwardly extending flap portion 74c which defines a valve opening.

A valve stem 75 carried by the dispenser head 72 is positioned within the upper end of the bulb section 74. As can be seen, the upper end of the valve stem is frictionally positioned within the centrally located tubular portion 72d. The valve stem further includes an enlarged flange 75a on its lower end which has an outer frusto-conical surface which mates with a similarly shaped interior surface 74j at the upper end of the bulb wall portion 74a that forms a valve seat.

Formed on the valve stem 75 immediately above the flange 75a is a cylindrical portion 75b which fits within the bulb tubular portion 74b. The upper annular surface or shoulder on the valve stem cylindrical portion 75b is tapered downwardly and inwardly to mate with the lower surfaces of the resilient annular flap 74c. Two or more axially extending passages 75d are formed on the exterior of the valve stem cylindrical portion 75b. With the valve stem 75 positioned as shown in FIG. 6, the bulb in an undepressed condition, both of the outlet valves are closed. That is, the lower flange 75a on the valve stem is engaging the surface 74j of the bulb to prevent fluid flow out of the bulb. Similarly, the upper surface of the valve stem cylindrical portion 75b is closing the orifice defined by the resilient flap 74c.

Figure 7:
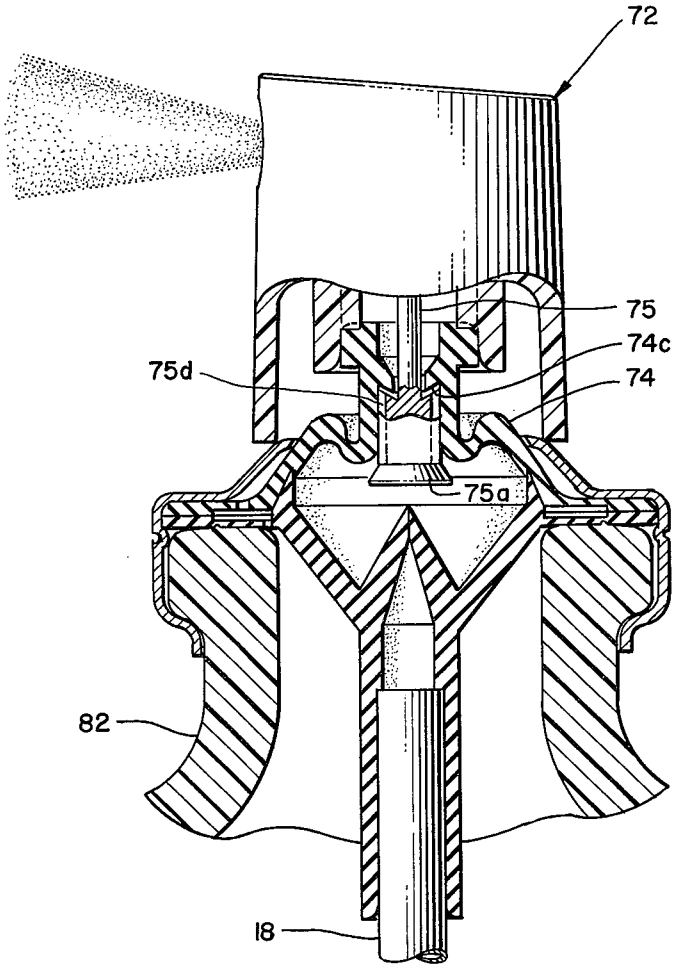
FIG. 7 is a cross-sectional view of the pump of FIG. 6 showing the bulb in depressed condition.

As with the previous pumps, the dispenser head 72 cannot be depressed further without distorting the bulb in that the lower shoulder defined by a series of ribs 72b on the dispenser head engage the upper end of the bulb tubular portion 74b. Thus, depressing the dispenser head further distorts the bulb decreasing the size of the pump chamber 77 thus creating pressure within the chamber. When the pressure is sufficient, the bulb lower section will be distorted slightly away from the valve stem flange 75a, as shown in FIG. 7. Once this occurs, the chamber pressure is also applied to the resilient flap 74c by way of the grooves 75d in the valve stem cylindrical portion 75b. When the pressure reaches a predetermined level, the flap 74c will be deflected upwardly slightly enabling the contents of the chamber to be dispensed upwardly into the passage 90 in the dispenser head and out the orifice cup 70. Once the pressure in the chamber drops below the predetermined level, the resilient flap 74c will return to its normal position sealing that orifice against the valve stem, and the bulb surface 74j will seal against the flange 75a.

The operation of the chamber inlet valve in the lower bulb section 76 and the operation of the air venting system for the container is as described above in connection with FIG. 1.

The pump of FIG. 7 provides many of the advantages of the other pumps and illustrates the versitility of distorting a resilient member adjacent a valve stem while creating pump chamber pressure in order to obtain substantially constant pressure for dispenser output.

It should be understood that the pumps described herein can be used in a wide variety of applications. Also, the pumps can be adapted to containers employing trigger operation for depressing the bulbs and the valve stems, employing the necessary actuating means most suitable for a given application.

What is claimed is:

1. A dispenser pump comprising:

a flexible bulb defining a pump chamber, said bulb being formed by an upper section and a lower section, each having an outwardly extending flange which is to engage the upper open end of a container with a portion of said lower bulb section extending into said container, said lower section including a depending tubular portion adapted to connect to a dip tube to extend into the container, said lower section further including integrally formed and upwardly extending flap means at the upper end of said tubular portion, said flap means mating together to form a normally closed one-way check valve which will open in response to reduced pressure within said chamber to suck fluid from said container into said chamber but will prevent flow from the chamber into the container, said upper bulb section including a pair of integrally formed flaps which extend downwardly toward said chamber and define a normally closed check valve which is urged to close by pressure in said chamber but permits flow out of said chamber when said flaps are forced apart, said upper section including a tubular portion surrounding said upper valve, said tubular portion having a cylindrical exterior and having relatively thick walls forming a pressure pad;

a dispenser head including a cylindrical portion which fits onto said bulb upper section cylindrical portion and having a surface engaging the upper end of said cylindrical portion which forms said pressure pad, said dispenser head including a bayonet valve stem having its lower end shaped to fit within the tubular portion of said upper bulb section and adapted to engage the flaps forming said upper valve and open said upper valve flaps when said dispenser head is pressed against said pressure pad with sufficient force to compress said bulb and create a predetermined pressure in said chamber that will cause said pressure pad to be compressed enough to permit said valve stem to separate said upper valve flaps, said valve stem having means defining a passage to connect said chamber to a dispenser orifice within said head; and means for clamping said bulb flanges on the upper end of said container, and means formed within said flanges for permitting air to enter said container to replace product sucked into said chamber.

2. A dispenser pump comprising:

a flexible bulb defining a pump chamber having a normally closed inlet valve on its lower end to be connected to a container preventing flow out of the chamber and permitting flow into the chamber when the pressure in the chamber is less than that in the container, and a normally closed outlet valve means on its upper end, said bulb having an enlarged resilient tubular portion forming a pressure pad on its upper end with the lower end of said tubular portion being connected to the sides of said bulb so that collapsing the bulb by a force applied to said pad compresses said tubular portion; and a dispenser head mounted on said bulb upper end over said pressure pad and including a valve stem which engages said outlet valve means, said head being movable in a direction to cause said valve stem to open said outlet valve only by depressing said head sufficiently to distort said bulb to create pressure within said chamber and further to compress said pressure pad against said chamber pressure.

3. The pump of claim 2 wherein said outlet valve means includes resilient flap means formed integrally with said bulb, said flaps being oriented so that pressure within said chamber urges said flaps into closed position and said valve stem is positioned to be urged to separate said flaps when the upper portion of said bulb is compressed against said chamber pressure.

4. The pump of claim 2 wherein said outlet valve means includes means on the interior of the upper end of said bulb defining a valve orifice, and said valve stem closes said orifice when the bulb is in the undepressed position, said valve stem having a passage which communicates with said chamber when the upper end of said bulb is compressed further against said chamber pressure.

5. The pump of claim 2 wherein said outlet valve means includes an annular surface on the inner upper portion of said bulb and further includes inwardly extending annular flap means on said bulb forming an orifice spaced above said annular surface, and said valve stem includes surfaces which mate with said bulb surface and said bulb orifice so that both of said valves are normally closed, the lower valve being openable upon sufficient pressure in the chamber to distort said annular surface away from the valve stem, and said flap being movable upwardly upon development of sufficient pressure within the chamber.

6. The pump of claim 2 wherein said valve on the lower end of said bulb comprises a pair of upwardly extending flaps formed integral with the valve, the upper ends of said flaps engaging each other and presenting upper surface angles which help the valve be forced into closed position by pressure within the chamber, said lower valve being openable by suitable pressure differential across said flaps.

7. The pump of claim 2 wherein said lower valve includes an upwardly extending wall defining a valve orifice, and including a valve stem positioned below said orifice with its upper end extending into the orifice to normally close the orifice, said means defining the orifice being movable upwardly by sufficient pressure differential across said orifice so as to move the material forming said orifice away from said valve stem, said valve stem having means defining a passage therethrough which permits fluid flow from the container past said valve stem into said chamber.

8. The dispenser pump of claim 2 wherein said bulb includes an upper section and a lower section each of which are separately molded and made to form said bulb, each of said sections having mating outwardly extending flanges to be positioned on the open top of a container with portions of these lower sections extending into the container; and a ferrule having a central opening which fits over the upper end of said upper section and engages the upper flange and includes means for clamping said flanges to the open upper end of the container.

9. The pump of claim 8 wherein each of said flanges have openings therethrough extending from the interior of the container to the exterior, and said ferrule sealingly engages the upper section of said bulb so that when the dispenser head is not compressing said bulb, the ferrule is sealed on the bulb preventing fluid flow into or out of said container, said bulb being moved inwardly from the ferrule when said dispenser head is depressed, thereby allowing air to enter the container past the ferrule and through the openings through said flanges to displace the volume occupied by the container contents which have been pumped from the container.

10. The dispenser pump of claim 2 wherein said outlet valve means includes downwardly extending resilient flaps formed integrally with said bulb, said flaps being self-biased against each other to form a normally closed valve and oriented so that pressure within said chamber urges said flaps closed, and said valve stem is positioned above said flaps so that when said pressure pad is compressed, said valve stem separates said flaps to allow flow out of said chamber, said stem having a passage which accommodates said flow when said flaps are open.

11. A dispenser pump of claim 2 wherein said outlet valve means includes an inwardly extending sealing bead on said bulb defining a valve orifice, and said valve stem includes a surface which engages said valve orifice and, in the undepressed position of said head, said valve stem surface closes said outlet valve orifice, said valve stem having a passage which communicates with said chamber when said pressure pad is compressed by depressing said head.

12. A dispenser pump comprising:

a flexible bulb defining a pump chamber having means forming an inlet valve on its lower end for permitting product to be sucked into the chamber and outlet valve means on its upper end for permitting flow out of said chamber, said bulb further having radially extending flange means;

a dispenser head mounted on said bulb upper end including a surface engaging the upper end of said bulb that limits further downward movement on the bulb upper end wihout bulb distortion;

a valve stem carried by said head which engages said outlet valve means in a manner such that the outlet valve is closed when the head is undepressed, said valve being openable by depressing said head sufficiently to create a predetermined pressure in said chamber and to distort the bulb enough to move the valve stem relative to said outlet valve means so as to permit product flow out of the chamber under a relatively constant predetermined pressure; and means for clamping said flange means on the open upper end of a container, said bulb further having an upwardly extending annular wall, the upper end of the annular wall being spaced outwardly from the pump chamber but being connected to a portion of the pump chamber by a series of spaced ribs which pull the upper portion of the annular wall inwardly when the pump chamber portion is depressed, thereby breaking a seal between the annular wall and said clamping means so that air may enter the container.

13. A dispenser pump comprising:

a flexible bulb defining a pump chamber having an outwardly extending annular flange adjacent its mid-section for supporting the bulb on the upper end of a container, said flange being made of resilient material so that it serves as a seal, passage means formed on said flange for connecting the interior of the container to the exterior;

a ferrule fitting over said bulb and engaging the upper surface of said flange to clamp the flange onto the upper end of said container, said ferrule including an annular portion adjacent said flange which encloses the outlet of said passage and seals against an outwardly facing surface of said bulb to prevent fluid flow through said passage when said bulb is in an undepressed condition; and a dispenser head mounted on the upper end of said bulb for depressing said bulb, said depressing action breaking the seal between the bulb and the ferrule to permit air into said container.

14. The dispenser pump of claim 13 wherein said bulb includes an upwardly extending peripheral wall attached to the bulb at its lower end but being spaced from the bulb at its upper end except for a series of spaced ribs joining the interior of the wall to the exterior of the bulb, the exterior of said wall engaging said ferrule to form said seal.

15. The dispenser pump of claim 14 wherein said ribs extend non-radially and include an undercut portion which facilitates inward movement of portions of said peripheral wall to break said seal upon depression of said bulb.

16. A pump for dispensing product with a substantially constant pressure comprising:

means defining a flexible pump chamber to be mounted on the open upper end of a container;

a dispenser head for varying the volume of said chamber to create pressure within the chamber;

means defining an inlet check valve which prevents flow out of the chamber but permits flow into the chamber from said container when the pressure in the chamber is less than that in the container;

means defining a normally closed outlet valve which prevents flow from said chamber below a predetermined pressure including a tubular resilient member having internal means defining a valve orifice; and a valve member carried by said head and extending into said tubular member adjacent said orifice, said dispenser head being mounted on said tubular member in a manner such that relative movement between the valve member and the resilient member in a valve opening direction can occur only with the creation of a predetermined pressure in said chamber and with compression of said resilient member.

17. The pump of claim 16 wherein said internal means comprises normally closed resilient flap means formed so that pressure within said chamber urges said flap means closed.

18. A dispenser pump comprising:

a flexible bulb defining a pump chamber, an inlet valve opening on its lower end permitting flow into the chamber, and outlet valve means formed on its upper end permitting flow out of said chamber, said outlet valve means including an upwardly extending neck formed on said bulb with a portion of said bulb joining said neck to the remainder of the bulb defining a tapered annular surface forming a valve seat, said neck further having flexible flap means above said valve seat extending inwardly to define a valve opening, a cylindrical space being formed between said valve seat and said valve opening; and a valve stem positioned in said neck having a lower cylindrical portion that fits within the cylindrical portion in said neck, having a lower flange portion which mates with said annular valve seat, and having an upwardly facing annular surface which mates with said flap means defining said opening, the valve stem further having means extending upwardly through said opening; and a dispenser head mounted on the upper end of said bulb neck with a portion of said head engaging the upper end of said neck, said head including means supporting said valve sem with its lower flange sealed against said valve seat, with its upwardly facing annular surface sealed against said flap and with said head in engagement with the upper end of said neck, the valve seat on said bulb being moveable away from said lower portion of said valve stem upon the application of a predetermined pressure to the interior of said bulb as applied by said head in compressing said bulb, and said flaps being responsive to pressure within said bulb neck and being moveable upwardly to permit flow out of said bulb at a predetermined pressure.

* * * * *